US007218743B2

(12) United States Patent
Sumiyama et al.

(10) Patent No.: US 7,218,743 B2
(45) Date of Patent: May 15, 2007

(54) SPEAKER MODULE AND APPARATUS USING THIS

(75) Inventors: Masahide Sumiyama, Mie (JP); Tetsuya Mouri, Mie (JP); Satoshi Itoh, Mie (JP); Takayoshi Yamasaki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/529,727

(22) PCT Filed: Oct. 1, 2004

(86) PCT No.: PCT/JP2004/014890

§ 371 (c)(1),
(2), (4) Date: Mar. 30, 2005

(87) PCT Pub. No.: WO2005/034573

PCT Pub. Date: Apr. 14, 2005

(65) Prior Publication Data

US 2005/0271232 A1 Dec. 8, 2005

(30) Foreign Application Priority Data

Oct. 3, 2003 (JP) ..... 2003-345416

(51) Int. Cl.
*H04R 25/00* (2006.01)
*H04R 1/02* (2006.01)
*H04R 1/00* (2006.01)

(52) U.S. Cl. ..... 381/186; 381/342; 381/431

(58) Field of Classification Search ..... 381/151, 381/186, 342, 388, 432, 89, 431
See application file for complete search history.

(56) References Cited

U.S. PATENT DOCUMENTS

| | | | | |
|---|---|---|---|---|
| 2003/0003879 | A1 | 1/2003 | Saiki et al. | |
| 2003/0174849 | A1 * | 9/2003 | Saiki et al. | 381/89 |

FOREIGN PATENT DOCUMENTS

| | | |
|---|---|---|
| JP | H1-159487 | * 11/1989 |
| JP | 11-252671 | 9/1999 |
| JP | 2000-23271 | 1/2000 |
| JP | 2000-331523 | 11/2000 |
| JP | 2001-095074 | 4/2001 |
| JP | 2003-179988 | 6/2003 |

* cited by examiner

*Primary Examiner*—Sinh Tran
*Assistant Examiner*—Brian Ensey
(74) *Attorney, Agent, or Firm*—McDermott Will & Emery LLP

(57) ABSTRACT

A speaker module includes a first diaphragm and a second diaphragm acoustically coupled with each other as a part of a wall forming a hermetic space with a panel. A light emitting section emits light to the panel, and the panel transmits the light to a side of the second diaphragm. The speaker module is configured to emit sound and light.

8 Claims, 3 Drawing Sheets

SPEAKER MODULE AND APPARATUS USING THIS

This application is a U.S. national phase application of PCT international application PCT/JP2004/014890.

TECHNICAL FIELD

The present invention relates to a speaker module used in various acoustic devices or information communication devices, and relates to various electric devices or apparatuses using the same.

BACKGROUND ART

FIG. 5 is a sectional view showing a conventional speaker module. Magnet 2 is sandwiched between upper plate 3 and yoke 1, so that inner magnet type magnetic circuit 4 is formed. Frame 8 is connected with yoke 1. First diaphragm 7 is bonded to a circumference of frame 8, and voice coil 6 connected with first diaphragm 7 is inserted into magnetic gap 5 of magnetic circuit 4. Thus, a speaker unit is constructed.

Panel 10 is connected with frame 8, and first diaphragm 7 is surrounded by panel 10 which is a part of a wall constructing hermetic space 12. Second diaphragm 11 is connected with panel 10, so that first diaphragm 7 and second diaphragm 11 are acoustically coupled with each other. Thus, speaker module 13 is constructed. This kind of speaker module is, for example, disclosed in Unexamined Japanese Patent Publication No. 2003-179988.

However, speaker module 13 is extremely difficult to be designed suitable for an electric device or an apparatus using it. Speaker module 13 is designed in such a manner that its outward appearance is substantially plane because the device, in which speaker module 13 is installed, is required to be thin, small and compact. Therefore, second diaphragm 11 has a plane shape. When second diaphragm 11 is designed, for example, a photograph or a picture is printed on a surface of second diaphragm 11. In this case, contents of the photograph or the picture are fixed, so that it does not make a high impact on a user.

In a case where the device, in which speaker module 13 is installed, has a display function such as liquid crystal, panel 10 and second diaphragm 11 are structured with transparent material. Then, a display section such as liquid crystal is placed under them, and speaker module 13 is installed in the electric device with second diaphragm 11 designed nothing. In this case, because panel 10 and second diaphragm 11 are transparent, speaker module 13 can not appeal its existence.

SUMMARY OF THE INVENTION

A speaker module of the present invention includes a magnetic circuit, a frame coupled therewith, a first diaphragm, a voice coil, a panel, a second diaphragm and a light emitting section. The first diaphragm is coupled with a periphery of the frame. The voice coil is coupled with the first diaphragm, and its part is inserted into a magnetic gap of the magnetic circuit. The panel is coupled with the frame. The second diaphragm is coupled with the panel, thereby forming a hermetic space with the first diaphragm and acoustically coupling with the first diaphragm. The light emitting section emits light to the panel. The panel transmits the light from the light emitting section to a side of the second diaphragm. Using the structure discussed above, the light from the light emitting section passes through the panel, and a part of the panel or the whole panel emits light, thereby appealing to eyes of users. As a result, the speaker module can appeal its existence, so that outward design which makes a high impact can be realized.

DETAILED DESCRIPTION OF THE EXEMPLARY EMBODIMENT

Figure 1:
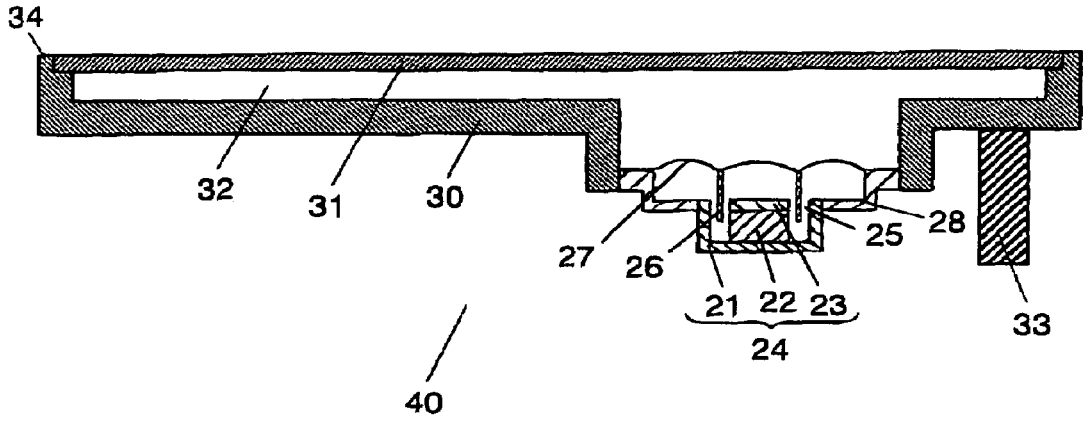
FIG. 1 is a sectional view of a speaker module in accordance with an exemplary embodiment of the present invention.

FIG. 1 is a sectional view of a speaker module in accordance with the exemplary embodiment of the present invention. Magnet 22 is sandwiched between upper plate 23 and yoke 21, so that inner magnet type magnetic circuit 24 is formed, and frame 28 is coupled with yoke 21. First diaphragm 27 is bonded to a periphery of frame 28, and voice coil 26 coupled with first diaphragm 27 is inserted into magnetic gap 25 of magnetic circuit 24. Thus, a speaker unit is constructed. Plate 23 and yoke 21 are made of magnetic metal having high permeability such as iron. Carbon steel for machine construction or rolled steel plate is commonly used as these materials. First diaphragm 27 is made of resin film such as polyethylene terephthalate. The inner magnet type speaker unit is shown in FIG. 1, however, an outer magnet type may be used.

Panel 30 is coupled with a periphery of frame 28 having frame portion 34. Second diaphragm 31 is bonded to panel 30 inside frame portion 34. First diaphragm 27 and second diaphragm 31 are acoustically coupled with each other via hermetic space 32. Thus, speaker module 40 is constructed. Light emitting section 33 is formed adjacent to panel 30, and light emitting section 33 emits light to panel 30. Panel 30 transmits the light from light emitting section 33 to at least a side of second diaphragm 31, and emits the light outside from frame portion 34. Whole panel 30 and second diaphragm 31 are more preferably formed transparent. It is enough for panel 30 to include transparent material such as glass or acrylic resin. More particularly, panel 30 is formed of general resin material implanting optical fibers positioned from light emitting section 33 to a side of second diaphragm 31, and made of material mentioned above, or whole panel 30 is formed of the transparent material discussed above. Second diaphragm 31 is acoustically coupled with first diaphragm 27, so that second diaphragm 31 is made of resin film having appropriate rigidity, such as polyethylene terephthalate or acryl.

In the structure discussed above, when light emitting section 33 emits light, the light passes through panel 30 and is transmitted to the side of second diaphragm 31. Thus, a part of panel 30 or whole panel 30 emits light, thereby appealing to eyes of users. Therefore, speaker module 40 can appeal its existence, so that outward design which makes a high impact can be realized.

In addition, if second diaphragm 31 is made of transparent material, objects to be displayed or contents disposed under second diaphragm 31 can be seen through second diaphragm 31. Further, if panel 30 whose part or whole is transparent is used, objects to be displayed or contents disposed under panel 30 can be seen through second diaphragm 31 and panel 30.

Luminous efficiency improves by using transparent material. Besides, in a case where display section or the like is designed under transparent second diaphragm 31 or transparent panel 30, objects to be displayed or contents can be seen by light from light emitting section 33, even when surroundings are dark.

Still further, second diaphragm 31 is preferably formed in substantially plane shape. In this case, by using the structural effect of second diaphragm 31, an electric device using speaker module 40 can be downsized or slim, or flexibility of design improves.

Yet further, second diaphragm 31 is preferably larger than first diaphragm 27 in area. Using this structure, because second diaphragm 31 is larger, sound pressure level improves. A section having a large surface area at a periphery of the electric device using speaker module 40 can be used as second diaphragm 31. Therefore, even when a small-sized electric device is used, a loud sound pressure level can be secured and efficient design can be realized.

Furthermore, a light emitting diode is preferably used as light emitting section 33. Using the structure mentioned above, electric power can be saved in speaker module 40.

As discussed above, the display section is designed by utilizing the space under transparent second diaphragm 31 or transparent panel 30, so that objects under second diaphragm 31 or panel 30 can be seen. Generally, a display section formed inside, i.e. under speaker module 40, is not visible from outside. However, the display section can be seen by forming panel 30 and second diaphragm 31 transparent. Therefore, electric devices including components required to be seen can be arranged not only in a horizontal direction in which heights of the components are substantially identical but also in a vertical direction in which the components are piled. As a result, even when large second diaphragm 31 is used, an electric device can be downsized or slim, or flexibility of design improves.

In addition, light emitting section 33 is formed adjacent to panel 30, so that light passes through panel 30, and a part of panel 30 or whole panel 30 emits light, thereby appealing to eyes of uses. As a result, speaker module 40 can appeal its existence, so that outward design which makes a high impact can be realized.

Figure 2:
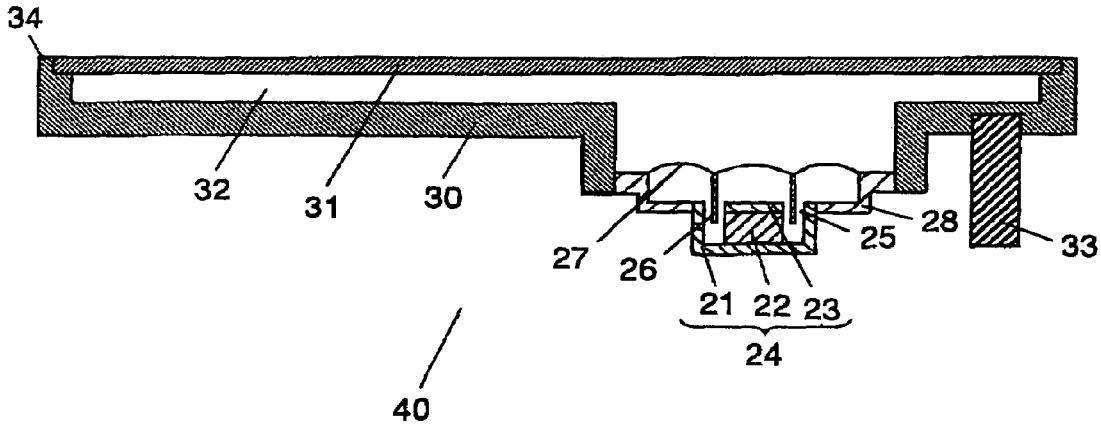
FIG. 2 is a sectional view of another speaker module in accordance with the exemplary embodiment of the present invention.

As shown in a sectional view of FIG. 2, light emitting section 33 may be implanted into panel 30. Using the structure mentioned above, whole size of light emitting section 33 and panel 30, which are combined each other, decreases by the amount corresponding to its implanting. As a result, an electric device can be downsized or slim, or flexibility of design improves. In addition, light transmittance for panel 30 is further improved by implanting light emitting section 33 into panel 30.

Figure 3:
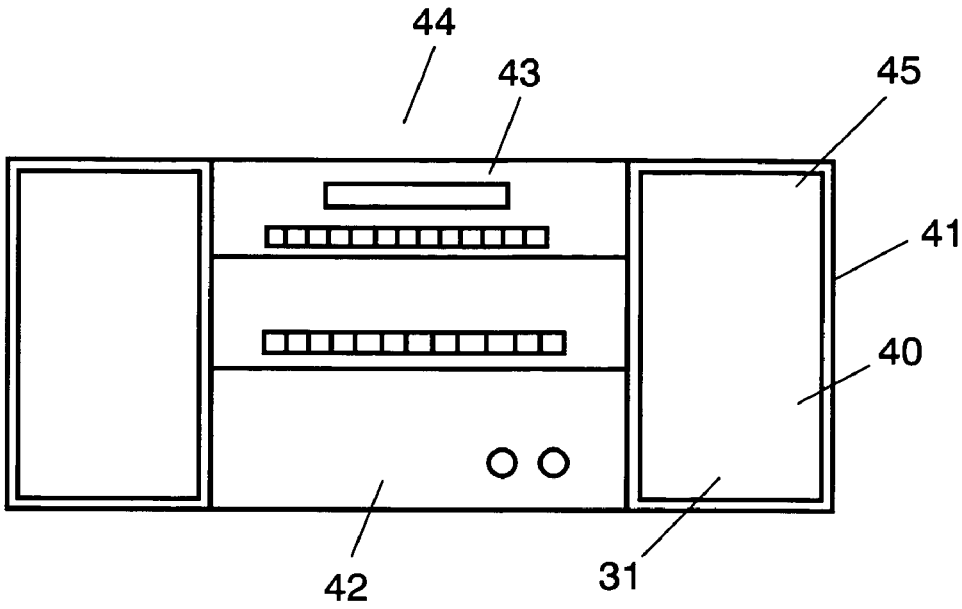
FIG. 3 is an outward appearance of an electric device in accordance with the exemplary embodiment of the present invention.

Next, an example of a device including speaker module 40 structured above is discussed hereinafter. FIG. 3 is an outward appearance of a mini component stereo system for audio as the device in accordance with the exemplary embodiment of the present invention.

Speaker module 40 is integrated into enclosure 41, whereby speaker system 45 is constructed. Amplifier 42 is an amplifier of an electric signal inputted into speaker system 45. Controlling section 43 such as a player outputs sources inputted into amplifier 42. As mentioned above, mini component stereo system 44 for audio as an electric device includes amplifier 42, controlling section 43 and speaker system 45. Amplifier 42, controlling section 43 and enclosure 41 are a main unit of mini component stereo system 44. In a word, speaker module 40 is installed into the main unit of mini component stereo system 44, and light emitting section 33 is supplied with electricity and emits light. Besides, voice coil 26 of speaker module 40 is supplied with electricity from amplifier 42 of the main unit and emits sound from second diaphragm 31.

In speaker module 40, second diaphragm 31 has an angular plane shape and is disposed at the whole front section of enclosure 41. As shown in FIG. 1 or FIG. 2, light emitting section 33 is formed adjacent to panel 30, or implanted into panel 30, and panel 30 transmits light from light emitting section 33 to the side of second diaphragm 31. Second diaphragm 31 is preferably formed of a transparent film, and panel 30 is preferably formed of transparent resin material such as an acrylic board.

According to the structure mentioned above, large panel 30 disposed at the front section of enclosure 41 of speaker system 45 emits light, thereby appealing to eyes of the users. Therefore, speaker module 40 can appeal its existence, so that outward design which makes a high impact can be realized. Moreover, even when large second diaphragm 31 is used, an electric device can be downsized or slim, or flexibility of design improves.

As discussed above, the mini component stereo system for audio is described as an application of speaker module 40 for a device, however, this invention is not limited to this embodiment. This invention can be also applied to a portable audio instrument, an electrically charging system for it or the like. Furthermore, this invention can be widely applied and developed into an image device such as a liquid crystal television or a plasma display television, an information communication device such as a portable telephone, or an electric device such as a computer-related device.

Figure 4:
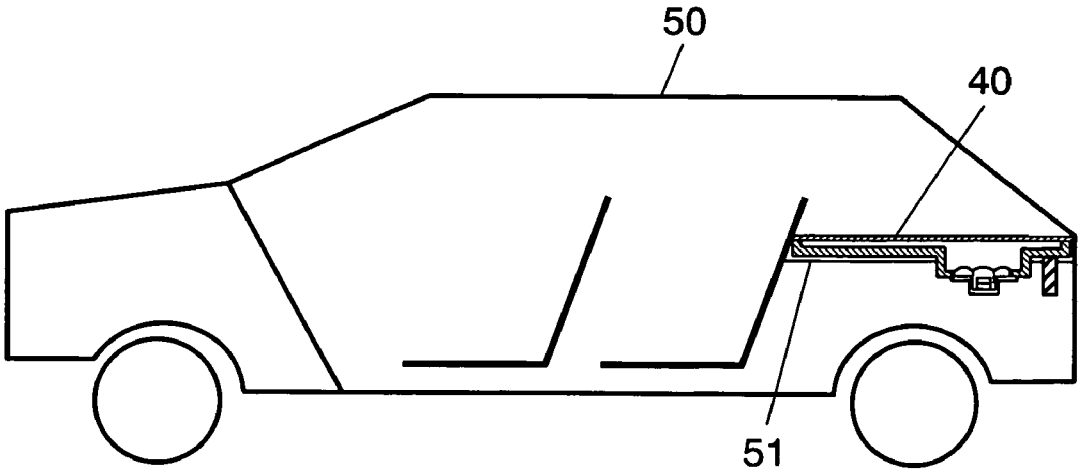
FIG. 4 is a sectional view of an apparatus in accordance with the exemplary embodiment of the present invention.
Figure 5:
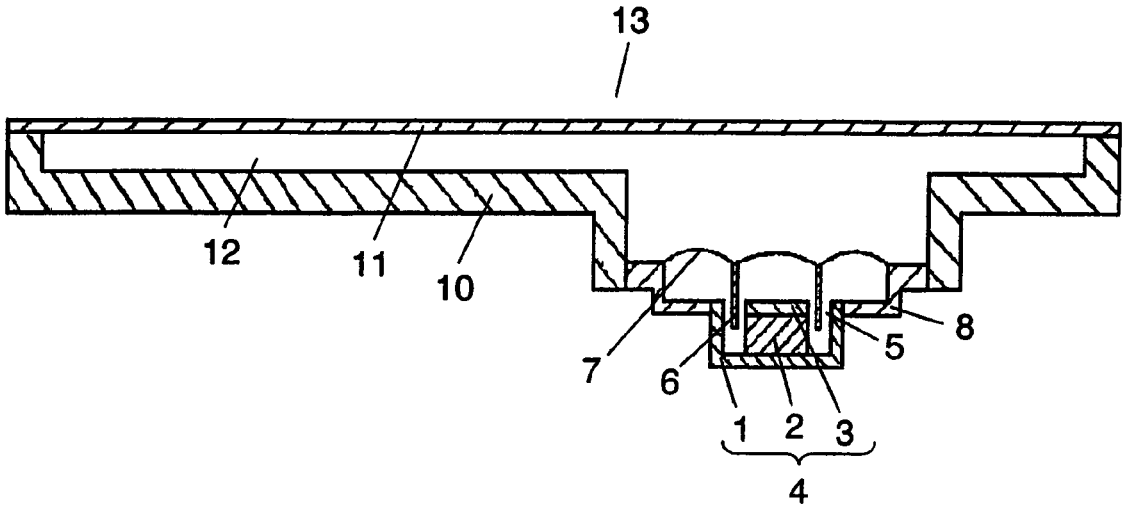
FIG. 5 PRIOR ART
FIG. 5 is a sectional view of a conventional speaker module.

Next, another example of a device including speaker module 40 is discussed hereinafter. FIG. 4 is a sectional view of an automobile, i.e. a device or an apparatus, in accordance with the exemplary embodiment of the present invention.

Speaker module 40 is incorporated in rear tray 51 of automobile 50. According to this structure, speaker module 40 installed in automobile 50 emits light, thereby appealing to eyes of users. In a word, speaker module 40 is installed into automobile 50 which is a main unit, and light emitting section 33 is supplied with electricity and emits light. Besides, voice coil 26 of speaker module 40 is supplied with electricity from automobile 50 which is the main unit, and emits sound from second diaphragm 31. Therefore, speaker module 40 can appeal its existence, so that design which makes a high impact can be realized. As a result, the speaker module, which is installed in the apparatus, as well as the apparatus such as an automobile can be downsized and slim, and design improves.

INDUSTRIAL APPLICABILITY

A speaker module of the present invention can be applied to various acoustic devices which are required to be designed for appealing to eyes of users using a light emitting function besides sound emitting function. In addition, the speaker module can be also applied to various electric devices, various apparatuses or the like. According to the present invention, the speaker module or an apparatus including the speaker module improves in design, thereby providing a great industrial value.

The invention claimed is:

1. A speaker module comprising:

a magnetic circuit having a magnetic gap;

a frame coupled with the magnetic circuit;

a first diaphragm coupled with a periphery of the frame, the first diaphragm having a first face and a second face opposing the first face;

a voice coil coupled with the first diaphragm at the first face, a part of the voice coil inserted into the magnetic gap;

a panel having a frame portion and being coupled with the periphery of the frame;

a second diaphragm coupled with the panel inside the frame portion, thereby forming a hermetic space with the panel and the first diaphragm, and acoustically coupled with the first diaphragm, the hermetic space facing the second face; and a light emitting section configured to emit light to the panel, wherein the panel transmits the light from the light emitting section to a side of the second diaphragm and emits the light outside from the frame portion.

2. The speaker module of claim 1, wherein the second diaphragm is made of transparent material.

3. The speaker module of claim 1, wherein the second diaphragm has a substantially plane shape.

4. The speaker module of claim 1, wherein the second diaphragm is larger than the first diaphragm in area.

5. The speaker module of claim 1, wherein at least a part of the panel is made of transparent material.

6. The speaker module of claim 1, wherein the light emitting section is implanted in the panel.

7. The speaker module of claim 1, wherein the light emitting section is a light emitting diode.

8. A device comprising:

a main unit; and a speaker module including:

a magnetic circuit having a magnetic gap;

a frame coupled with the magnetic circuit;

a first diaphragm couple with a periphery of the frame;

a voice coil coupled with the first diaphragm, a part of the voice coil inserted into the magnetic gap;

a panel having a frame portion and being coupled with the periphery of the frame;

a second diaphragm coupled with the panel inside the frame portion, thereby forming a hermetic space with the panel and the first diaphragm, and acoustically coupled with the first diaphragm; and a light emitting section configured to emit the light to the panel, wherein the panel transmits the light from the light emitting section to a side of the second diaphragm and emits the light outside from the frame portion, wherein the speaker module is installed into the main unit, supplied with electricity from the main unit to the light emitting section, and emits light, wherein the speaker module is supplied with electricity from the main unit to the voice coil, and emits sound.

* * * * *